US011028983B2

(12) United States Patent
Ye et al.

(10) Patent No.: US 11,028,983 B2
(45) Date of Patent: Jun. 8, 2021

(54) DOWNLIGHT APPARATUS

(71) Applicant: XIAMEN ECO LIGHTING CO. LTD., Xiamen (CN)

(72) Inventors: Jinying Ye, Xiamen (CN); Qiqing Yu, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/235,187

(22) Filed: Dec. 28, 2018

(65) Prior Publication Data

US 2019/0203893 A1 Jul. 4, 2019

(30) Foreign Application Priority Data

Dec. 28, 2017 (CN) ..... 201721888525.9

(51) Int. Cl.

| | |
|---|---|
| ***F21V 23/04*** | (2006.01) |
| ***F21V 7/04*** | (2006.01) |
| ***F21V 29/70*** | (2015.01) |
| ***F21Y 115/10*** | (2016.01) |
| ***F21S 8/02*** | (2006.01) |
| *F21Y 113/13* | (2016.01) |

(52) U.S. Cl.

CPC ..... *F21S 8/024* (2013.01); *F21V 7/04* (2013.01); *F21V 23/0435* (2013.01); *F21V 29/70* (2015.01); *F21Y 2113/13* (2016.08); *F21Y 2115/10* (2016.08)

(58) Field of Classification Search

CPC ..... F21S 8/024; F21S 8/026

See application file for complete search history.

(56) References Cited

U.S. PATENT DOCUMENTS

| | | | | |
|---|---|---|---|---|
| 4,631,377 | A * | 12/1986 | Imazeki | H01H 15/025 200/16 F |
| 10,448,477 | B2 * | 10/2019 | Bogart | G05F 1/10 |
| 2007/0086199 | A1 * | 4/2007 | Demarest | A01M 1/2083 362/441 |
| 2012/0087117 | A1 * | 4/2012 | Tukker | F21K 9/00 362/231 |
| 2012/0146505 | A1 * | 6/2012 | Jonsson | H05B 45/39 315/50 |
| 2017/0227207 | A1 * | 8/2017 | Bendtsen | F21V 15/01 |
| 2018/0206305 | A1 * | 7/2018 | Van Winkle | H05B 33/0857 |
| 2019/0373701 | A1 * | 12/2019 | Halliwell | F21K 9/232 |

* cited by examiner

*Primary Examiner* — Jong-Suk (James) Lee
*Assistant Examiner* — Eric T Eide
(74) *Attorney, Agent, or Firm* — Chun-Ming Shih; Lanway IPR Services

(57) ABSTRACT

A LED downlight apparatus includes a light source plate, a heat sink, a reflective cup and a driver container. The reflective cup reflects light of the light source plate and the heat sink is arranged between the driver container and the light source plate.

15 Claims, 11 Drawing Sheets

DOWNLIGHT APPARATUS

FIELD

The present invention is related to a LED apparatus and more particularly related to a LED downlight apparatus.

BACKGROUND

Downlight devices are widely used in the world, but people still look for better design with low cost and better visual effect.

Therefore, in such crowded art, any improvement may bring a great advantages for human life.

SUMMARY OF INVENTION

In some embodiments, a downlight apparatus includes a light source plate, a driver box, a switch button and a switch unit.

The light source plate is mounted with a first set of LED chips and a second set of LED chips. The color temperature of the first set of LED chips being different from the second set of LED chips. More than two sets of LED chips may be used in alternative options.

The driver box has a top driver box and a bottom driver box for containing a driver plate. The driver plate is mounted with a driver circuit for receiving a color temperature setting to adjust a light ratio between the first set of LED chips and the second set of LED chips. The top driver box includes a thin hole and a sliding groove.

The switch button has a switch socket. The switch unit is mounted on the driver plate with a lever protruding upwardly inserting into the switch socket. In other words, the switch button and the switch unit form a switch assembly that has better robustness and easy to be assembled.

The switch button is disposed on a top side of the top driver box and the switch unit is disposed on a bottom side of the top driver box. The switch button is capable of sliding along the sliding groove limiting by the thin hole corresponding to different color temperature settings of the driver circuit.

A position of the switch button with respect to the sliding groove causes the driver circuit to generate a corresponding driving ratio to the first set of LED chips and the second set of LED chips. Specifically, when the driving ratio changes, different driving current ratio apply to the first set of LED chips and the second set of LED chips. For example, the driver circuit changes driving currents to one or both sets of the LED chips.

In some embodiments, there are multiple candidate positions for the switch button to be moved, corresponding to multiple corresponding color temperatures.

In some embodiments, the driver circuit comprises a PWM controller for adjusting a first duty ratio of the first LED chips and a second duty ratio of the second LED chips to change a mixed color temperature of the first set of LED chips and the second set of LED chips. PWM is pulse width modulation technique, which rapidly turns on and turns off a LED component to produce different luminance level of the LED component.

The duty ratio in PWM refer to the turn-on period to overall time ratio. Specifically, the duty ratio may be 40%, which means 40% of time the LED component is turned on by PWM controlling.

PWM itself is known to persons skilled in the art. For brevity, no further detailed teaching is provided here.

In some embodiments, the summation of the first duty ratio and the second duty ratio is 100%. In other words, when one set of LED chips has 40% duty ratio, the other set of LED chips has 60% duty ratio.

In some embodiments, when the first set of LED chips are turned on, the second set of LED chips are turned off. When the first set of LED chips are turned off, the second set of LED chips are turned on. With such design, the overall current of the two sets of LED chips may be maintained in a regular level to increase overall efficiency.

In some embodiments, the driver circuit comprises a wireless circuit. An external command from an external device like a mobile phone or a remote control is sent to the wireless circuit to disable a function of the switch unit. For example, a mobile phone with an installed app may send a wireless command via Wi-Fi or Bluetooth networks to the wireless circuit. The wireless circuit receives the external command and converts to corresponding PWM signals to control the first set of LED chips and the second set of LED chips. The wireless command may also be used to bypass the function of the switch assembly.

In some embodiments, when the switch unit is disabled, a position change of the switch button does not change the corresponding driving ratio of the first set of LED chips and the second set of LED chips.

In some embodiments, a LED downlight apparatus includes a light source plate, a heat sink, a reflective cup and a driver container.

The downlight apparatus is fixed to a cavity or an installation box of a ceiling. A part of the downlight apparatus is exposed and visible by users while the other part of the downlight apparatus is hidden in the ceiling.

Multiple LED chips, which may be packed in flip chip packaging or other packing methods, are mounted on the light source plate. Some driver circuit may be also mounted on the light source plate.

When all necessary driver circuit components are disposed on the light source plate, the driver container mentioned below may be removed.

In other words, the driver and the light source components may be divided into two parts in some embodiments and may be integrated together on the light source plate.

In some embodiments, the light source plate may include a metal substrate, an insulation layer and a wiring layer. The LED chips are electrically connected to the wiring layer so as to form an electrical loop connected in series, in parallel, or in series and in parallel. For the connection type of in series and in parallel, it means some LED chips are connected in series and multiple series connected LED chips are further connected in parallel, or in other ways, depending on design requirements and LED chip characteristics. For example, the LED chips are arranged to meet an external power source voltage so as to decrease the complexity of corresponding driver components.

The LED chips may include only one type of LED chips, e.g. emitting a light with the same spectrum and/or color temperature. In some other embodiments, the LED chips may include multiple types of LED chips, e.g. with different color temperatures, color or other optical parameters.

When multiple types of LED chips, the LED chips may be used for mixing one or more than one optical settings, like several color temperatures.

Furthermore, a manual switch may be connected to a driver circuit for receiving a user operation to change color temperatures of the downlight apparatus. In some other embodiments, different driving currents or different duty ratio currents are supplied to the LED chips to mix desired optical parameters.

The light source play may be a circular flat plate or other geometrical structure. One side that facing down side with respect to a ceiling is called the bottom side. The bottom side of the light source plate is used for mounting the LED chips.

The heat sink includes a heat contact part and a heat dissipating part. The heat contact part is close to a heat source, like the light source plate, by directly or indirectly contacting the light source plate. For example, the heat contact part directly engages the light source plate. In some other designs, additional heat material like heat dissipation glue may be applied between the light source plate and the heat contact part of the heat sink.

The heat contact part may have a contact area with similar shape as the light source plate for the two parts to engage more closely.

The heat sink includes a heat contact part and a heat dissipating part. In some embodiments, the heat contact part has a shape corresponding to the light source plate. For example, the heat contact part may have a contact area with similar shape as the light source plate for the two parts to engage more closely. In some other embodiments, the heat contact part is a ring structure directly or indirectly engaging a peripheral area of the light source plate.

Some heat dissipating material, like glue, may be applied to further enhance heat transmission between the heat contact part of the heat sink and the light source plate.

Heat received from the heat contact part of the heat sink is further transmitted to the heat dissipating part. The heat dissipating part further transmits received heat to one or more other components.

In some embodiments, the heat sink is placed above the light source plate. Specifically, a bottom side of the heat contact part is heat connected to a top side of the light source plate. The term "heat connected" refer to heat conduction between two components with directly engagement or indirectly engagement with some other components like heat dissipating material placed between the two components.

The reflective cup includes a neck portion heat connected to the heat dissipating part. Specifically, in some embodiments, the reflective cup has a widen bottom edge and a narrow top edge. The neck portion refers to the area close to the narrow top edge. The reflective cup may have an opening corresponding to the shape of the light source plate.

In addition, the reflective cup has a top surface heat connected to the heat dissipating part of the heat sink. With such design, heat of the light source plate is carried from the heat contact part of the heat sink to the heat dissipating part of the heat sink. In addition, heat is further transmitted from the heat dissipating part of the heat sink to the reflective cup. The heat dissipating part of the heat sink may directly engage the top surface of the reflective part, or indirectly engage the top surface of the reflective cup, e.g. applying some heat dissipating glue between the top surface of the reflective cup and the heat dissipating part of the heat sink.

The reflective cup has an inner reflective surface surrounding the light source plate for reflecting a light emitting from the light source plate to predetermined directions. Specifically, the inner reflective surface may form a surrounding dome or cup shape with a light opening.

Light emitted from the light source plate may escape from the light opening directly, or be emitted to the inner reflective surface of the reflective cup and reflected for one or multiple times before the light is escaped from the light opening.

There may be a diffusion cover covering the light opening, or other designs like some mentioned below.

The inner reflective surface may be attached with reflective material like white paint, or disposed with optical guiding structures for showing shining surface or enhancing light reflection.

In some embodiments where driver circuits are not directly integrated with the light source plate, the driver circuits are placed in the driver container. The driver container may be a box of any geometrical shape, e.g. with a bottom shape similar to the top edge of the reflective cup and the light source plate.

In some embodiments, the driver container may also contain wireless or wire communication circuits and related processing circuits for converting an external command to a corresponding signal to control the LED downlight apparatus.

The driver circuit is electrically connected to the LED chips via a conductor path, e.g. wires or conductive strips. In some embodiments, the driver container may have a passing hole for the conductor path to pass through. Furthermore, the heat sink may also have a passing hole for the conductive path to route and to connect to the LED chips of the light source plate. In some embodiments, the passing hole may contain one or more sub holes corresponding to wire.

Plugging sockets may also be used for electrically connecting the driver circuit to the LED chips. The driving current converted by the driver circuit is sent to the LED chips.

The light source plate has a heat dissipating substrate for conducting heat of the LED chips to the heat contact part of the heat sink.

In some embodiments, the driver container engages a top side of the heat contact part of the heat sink. There are various ways to implement this feature. For example, the heat sink is arranged between the driver container and the light source plate. In such design, heat of the light source plate may also be transmitted to the driver container. When the driver container is made of metal material, the driver container may also be used for heat dissipation.

In some embodiments, the driver container has a bottom side and a lateral wall. At least a part of the lateral wall of the driver container engages the heat contact part of the heat sink. For example, when the driver container is a circular box, the bottom side of the circular box may engage a first part of the heat contact part of the heat sink and the lateral side are partly or completely engage a second part of the heat contact part of the heat sink.

For example, the heat contact part of the heat sink may be a cup shape structure so that the driver container is placed in the cup structure.

In some other embodiments, at least another part of the lateral wall is not contacting the heat sink. In such case, the driver container may not need to completely surrounded by the heat contact part of the heat sink.

In some embodiments, a heat sink height of the heat sink is less than 50% of a reflective cup height of the reflective cup. With the design mentioned above, the overall height of the LED downlight apparatus may be decreased.

In some embodiments, the heat sink may spread and cover most of the reflective cup. In some other embodiments, to decrease cost, the heat sink only covers part of the reflective cup, e.g. less than 50% of height of the reflective cup.

In some embodiments, the driver circuit is mounted on a circuit plate. The circuit plate is attached to the bottom side of the driver container. With such design, the heat of the driver circuit may easily carried away by the heat contact part, too.

In some embodiments, the reflective cup and the heat sink are circular shape structures.

In some embodiments, the inner surface of the reflective cup are disposed with polygonal structures.

Specifically, in a first design, the polygonal structures have convex protruding surface. Such design brings a first optical guiding and visual effect.

In some other design, the polygonal structures have concave surface, which brings a second optical guiding and visual effect.

The polygonal structures may look like fins of a fish or a crystal decoration.

In some embodiments, the polygonal structures close to the light source plate and away from the light source plate are different. For example, the polygonal structure may have different sizes for those near the top edge of the reflective cup compared to those near the bottom edge of the reflective cup.

In some embodiments, the heat sink forms a concave cup facing upwardly and the light source plate is placed in the concave cup. In such design, the reflective cup may have two inverted curve surfaces. The first curve surface forms a first cup for reflecting the light of the light source plate and the second curve surface forms a second cup for holding the driver container.

Such design may further decrease the overall height of the downlight apparatus.

In some embodiments, the reflective cup comprises a streamline bell shape structure.

In some embodiments, the downlight apparatus also has a shielding cover covering the light source plate. The light emitted from the plurality of LED modules passes through the shielding cover.

In some embodiments, the shielding cover has a bottom lens for forming a light beam and a lateral wall of the shielding cover for passing light on the reflective cover forming a second luminous source. For example, the light of the second luminous source emits to the inner reflective surface while the light via the bottom lens is directly emitting outside the LED downlight apparatus.

In some embodiments, the reflective cup has a hook structure for plugging and fixing the shielding cover. The hook may have an inverted hook to prevent detachment between the reflective cup and the light source plate.

In some embodiments, the downlight apparatus may also has a heat conductive layer disposed between the light source plate and the heat sink. Glue or other heat conductive material may be used for forming the heat conductive layer.

In some embodiments, the heat sink is made of metal material.

In some embodiments, the heat sink has a plurality of protruding bars on a surface of the heat sink to increase the rigidity of the heat sink and the reflective cover. Such protruding bars may form a grid or other shape to strengthen the rigidity of the attached reflective cup.

In some embodiments, the light source plate also engages an edge of the reflective cup.

DETAILED DESCRIPTION

Figure 1:
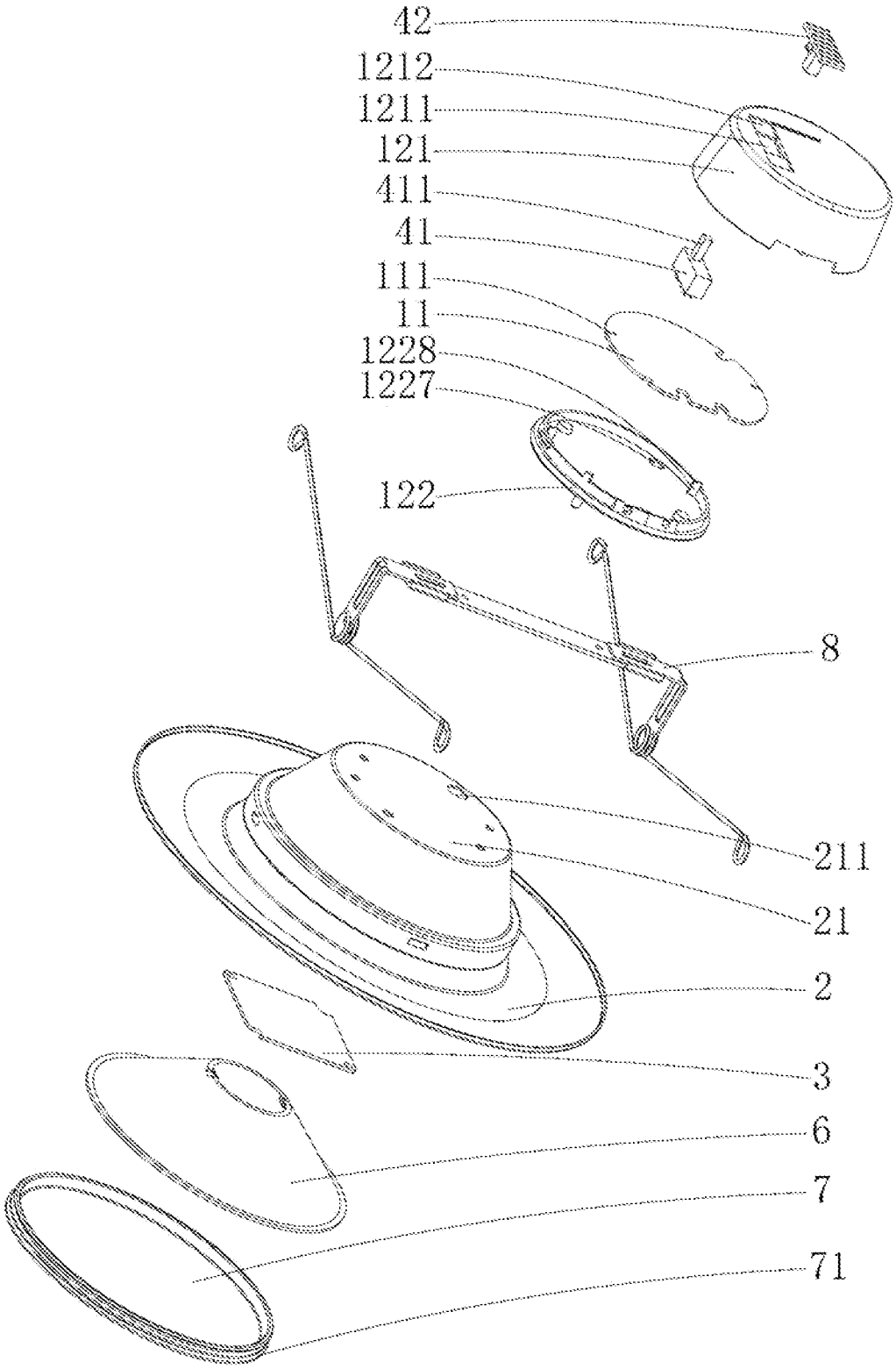
FIG. 1 is an exploded view of components in a downlight apparatus embodiment.

Please refer to FIG. 1 to FIG. 9. FIG. 1 is an exploded view of components in a downlight apparatus embodiment.

Figure 2:
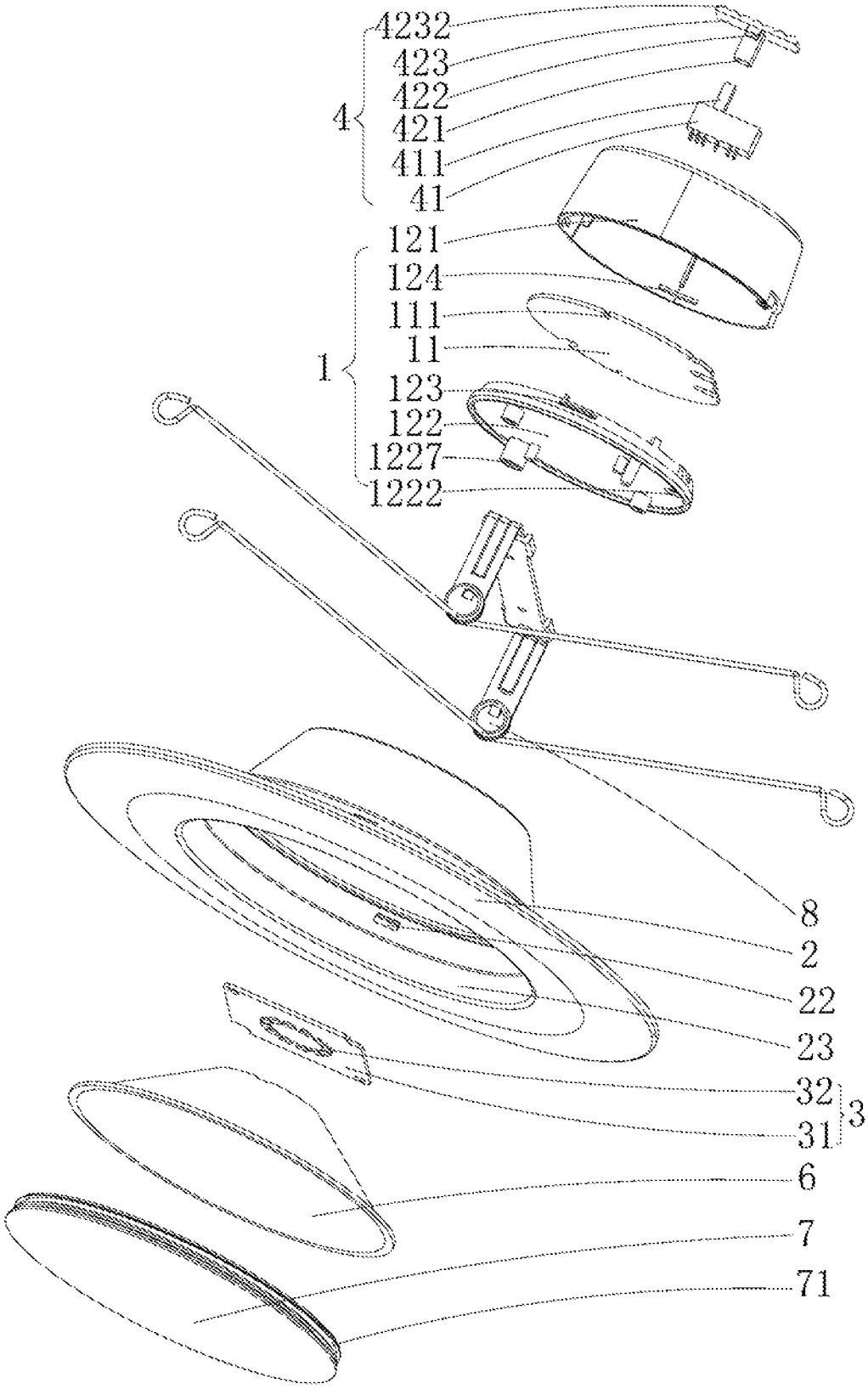
FIG. 2 is another view of FIG. 1.
Figure 3:
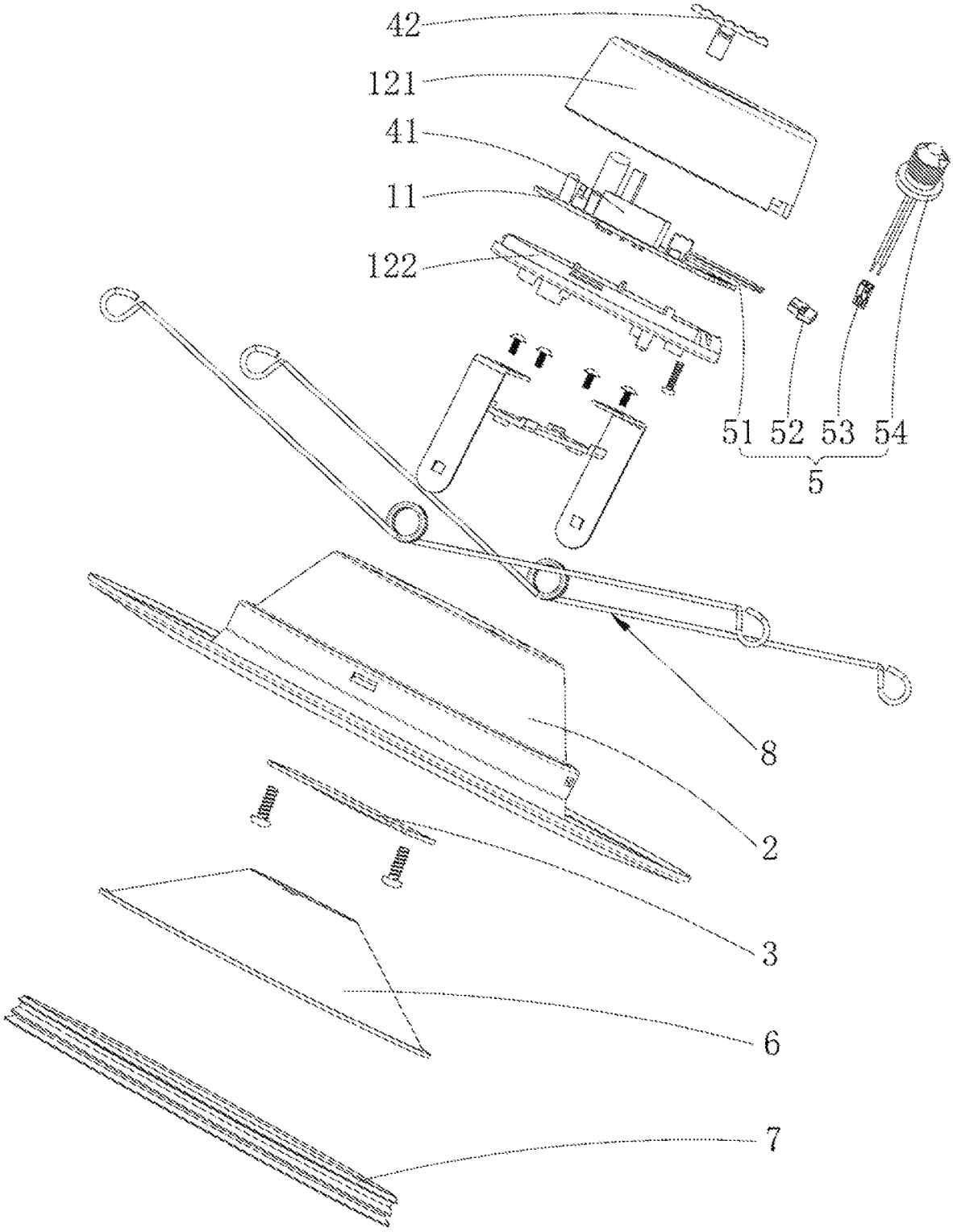
FIG. 3 is another view of FIG. 1.
Figure 4:
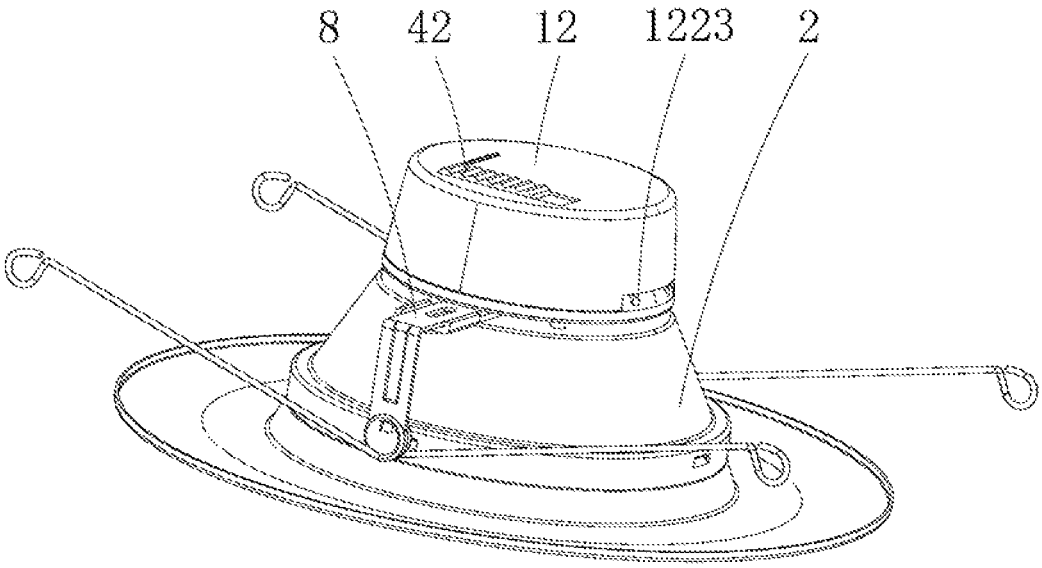
FIG. 4 is an assembled view of the embodiment in FIG. 1.
Figure 5:
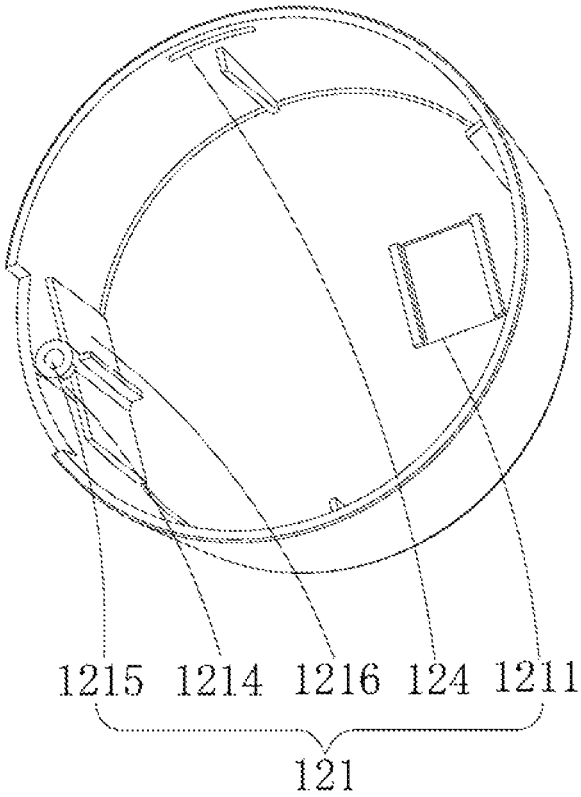
FIG. 5 is a component in the embodiment of FIG. 1.
Figure 6:
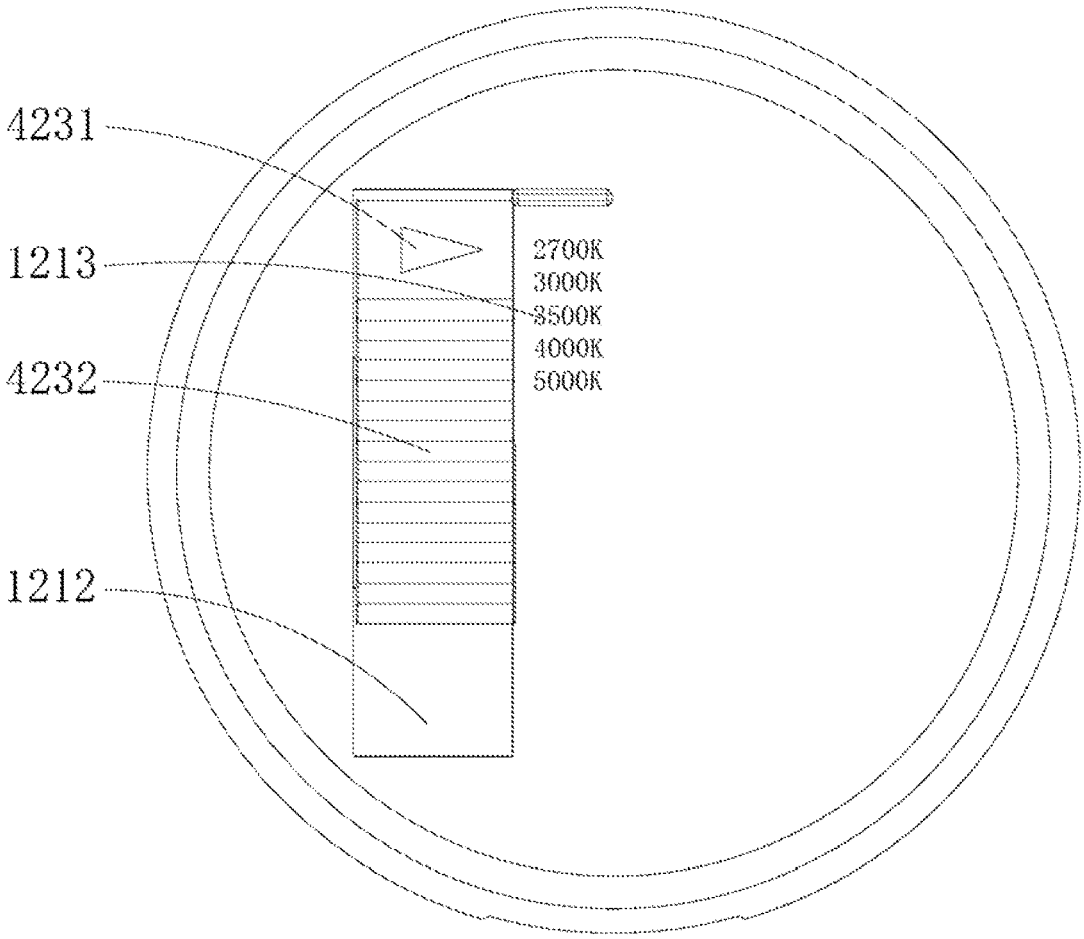
FIG. 6 illustrates an example of a switch example.
Figure 7:
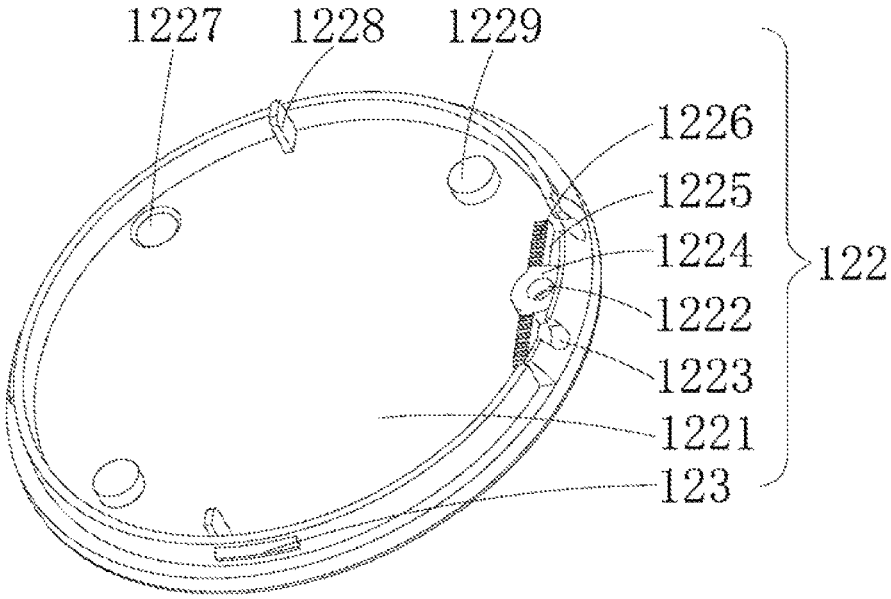
FIG. 7 illustrates a component in FIG. 1.
Figure 8:
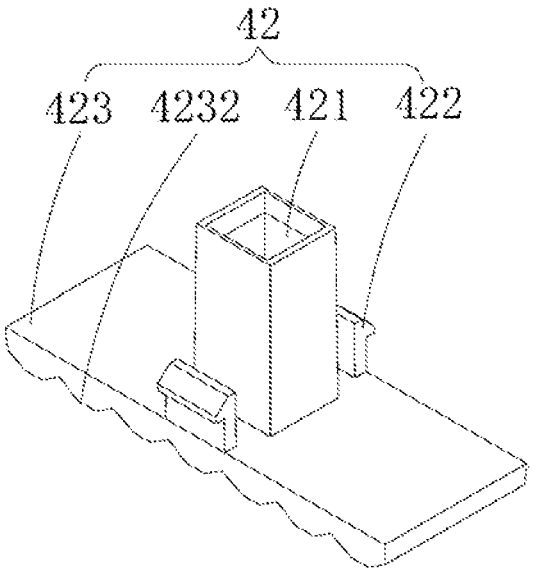
FIG. 8 illustrates a switch component.
Figure 9:
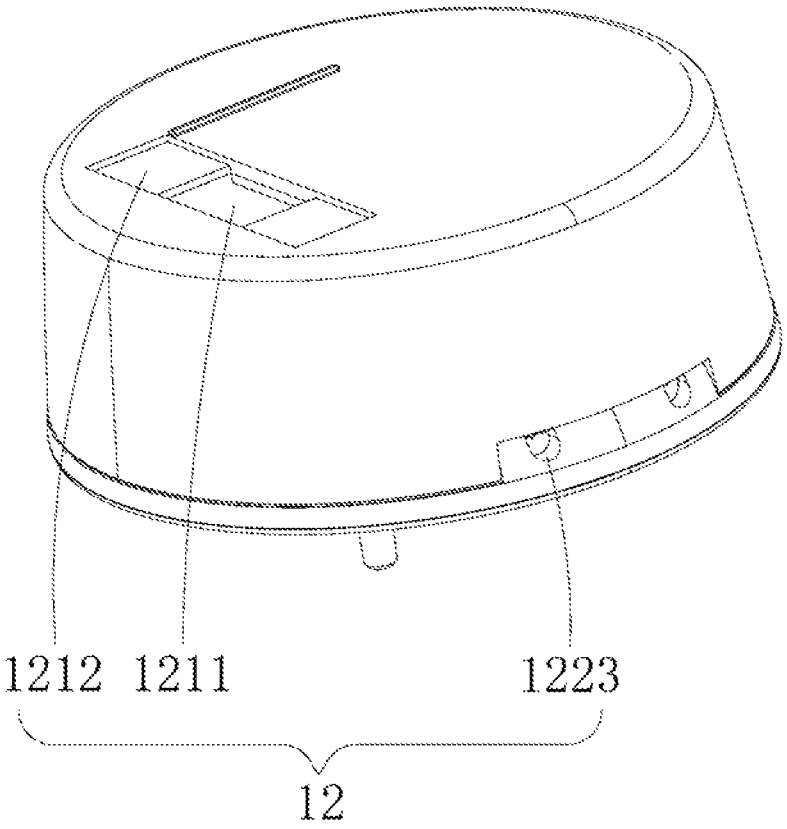
FIG. 9 illustrates a switch component.

FIG. 2 is another view of FIG. 1. FIG. 3 is another view of FIG. 1. FIG. 4 is an assembled view of the embodiment in FIG. 1. FIG. 5 is a component in the embodiment of FIG. 1. FIG. 6 illustrates an example of a switch example. FIG. 7 illustrates a component in FIG. 1. FIG. 8 illustrates a switch component. FIG. 9 illustrates a switch component.

In these drawings, components with the same reference numerals refer to the same components.

In FIG. 1, a switch button 42 is integrated with a switch unit 41 so that users may slide the switch button along a sliding groove 1212. The switch button 42 is disposed on a top side of a top driver box 121 that has a thin hole 1211 below the sliding groove 1212.

The switch unit 41 has a lever 411 to be inserted into the switch button 42. The top driver box 121 and the bottom driver box 122 form a driver box for containing a driver plate 11. The driver plate 11 is used for mounting a driver circuit.

There are some guiding grooves 111 for positing and aligning the components during assembly. There are also wire holes 1227, 211 for a wire to pass through. Two elastic springs 8 are disposed on a bar mounted on a top part 21 of a main housing 2 of the downlight apparatus. The main housing 2 has a cup container with a light opening enclosed by a light passing cover 7. A reflective cup 6 is installed inside the main housing 2. There is a groove 71 for installing the light passing cover 7.

In FIG. 2, the switch button has a button top 4332 with grooves on a surface of a button plate 423. There is an inverse hook to lock the switch button to the switch unit 41. The switch button and the switch unit 41 together form a switch assembly 4. The switch button has a button socket 421 corresponding to the lever 411 of the switch unit 41. The switch button is disposed on a top side of a top driver box 121 and the switch unit 41 is disposed on a bottom side of the top driver box 121. There are convex grooves 124, protruding block 123, wire hole 1227, installation hole 1222 and guiding groove 111 for installing the top driver box 121 to the bottom driver box 122.

The driver plate 11 is disposed between the top driver box 121 and the bottom driver box 122. The light opening 23 allows light to escape and other components are mentioned in FIG. 1.

In FIG. 3, an Edison light head 54 is attached to a female terminal 53 connected to a male terminal 52 and then to a wire 51 to the driver plate 11.

FIG. 4 shows components that are mentioned above.

In FIG. 5, the top driver box has installation structures 1215, 1214, 1216, 124. a a think hole 1211.

In FIG. 6, a switch button has an indicator 4231 directing to different labels 1213 when placed in different positions. There is a button top 4232 with grooves to easily slide.

In FIG. 7, installation structures 1226, 1225, 1224, 1222, 1223, 1221, 123, 1227, 1228 are illustrated on the drawing.

FIG. 8 and FIG. 9 show enlarged view of the switch assembly. The same reference numerals refer to the same components in previous drawings.

In some embodiments, a downlight apparatus includes a light source plate, a driver box, a switch button and a switch unit.

The light source plate is mounted with a first set of LED chips and a second set of LED chips. The color temperature of the first set of LED chips being different from the second set of LED chips. More than two sets of LED chips may be used in alternative options.

The driver box has a top driver box and a bottom driver box for containing a driver plate. The driver plate is mounted with a driver circuit for receiving a color temperature setting to adjust a light ratio between the first set of LED chips and the second set of LED chips. The top driver box includes a thin hole and a sliding groove.

The switch button has a switch socket. The switch unit is mounted on the driver plate with a lever protruding upwardly inserting into the switch socket. In other words, the switch button and the switch unit form a switch assembly that has better robustness and easy to be assembled.

The switch button is disposed on a top side of the top driver box and the switch unit is disposed on a bottom side of the top driver box. The switch button is capable of sliding along the sliding groove limiting by the thin hole corresponding to different color temperature settings of the driver circuit.

A position of the switch button with respect to the sliding groove causes the driver circuit to generate a corresponding driving ratio to the first set of LED chips and the second set of LED chips. Specifically, when the driving ratio changes, different driving current ratio apply to the first set of LED chips and the second set of LED chips. For example, the driver circuit changes driving currents to one or both sets of the LED chips.

In some embodiments, there are multiple candidate positions for the switch button to be moved, corresponding to multiple corresponding color temperatures.

In some embodiments, the driver circuit comprises a PWM controller for adjusting a first duty ratio of the first LED chips and a second duty ratio of the second LED chips to change a mixed color temperature of the first set of LED chips and the second set of LED chips. PWM is pulse width modulation technique, which rapidly turns on and turns off a LED component to produce different luminance level of the LED component.

The duty ratio in PWM refer to the turn-on period to overall time ratio. Specifically, the duty ratio may be 40%, which means 40% of time the LED component is turned on by PWM controlling.

PWM itself is known to persons skilled in the art. For brevity, no further detailed teaching is provided here.

In some embodiments, the summation of the first duty ratio and the second duty ratio is 100%. In other words, when one set of LED chips has 40% duty ratio, the other set of LED chips has 60% duty ratio.

In some embodiments, when the first set of LED chips are turned on, the second set of LED chips are turned off. When the first set of LED chips are turned off, the second set of LED chips are turned on. With such design, the overall current of the two sets of LED chips may be maintained in a regular level to increase overall efficiency.

In some embodiments, the driver circuit comprises a wireless circuit. An external command from an external device like a mobile phone or a remote control is sent to the wireless circuit to disable a function of the switch unit. For example, a mobile phone with an installed app may send a wireless command via Wi-Fi or Bluetooth networks to the wireless circuit. The wireless circuit receives the external command and converts to corresponding PWM signals to control the first set of LED chips and the second set of LED chips. The wireless command may also be used to bypass the function of the switch assembly.

In some embodiments, when the switch unit is disabled, a position change of the switch button does not change the corresponding driving ratio of the first set of LED chips and the second set of LED chips.

In some embodiments, a LED downlight apparatus includes a light source plate, a heat sink, a reflective cup and a driver container.

The downlight apparatus is fixed to a cavity or an installation box of a ceiling. A part of the downlight apparatus is exposed and visible by users while the other part of the downlight apparatus is hidden in the ceiling.

Multiple LED chips, which may be packed in flip chip packaging or other packing methods, are mounted on the light source plate. Some driver circuit may be also mounted on the light source plate.

When all necessary driver circuit components are disposed on the light source plate, the driver container mentioned below may be removed.

In other words, the driver and the light source components may be divided into two parts in some embodiments and may be integrated together on the light source plate.

In some embodiments, the light source plate may include a metal substrate, an insulation layer and a wiring layer. The LED chips are electrically connected to the wiring layer so as to form an electrical loop connected in series, in parallel, or in series and in parallel. For the connection type of in series and in parallel, it means some LED chips are connected in series and multiple series connected LED chips are further connected in parallel, or in other ways, depending on design requirements and LED chip characteristics. For example, the LED chips are arranged to meet an external power source voltage so as to decrease the complexity of corresponding driver components.

The LED chips may include only one type of LED chips, e.g. emitting a light with the same spectrum and/or color temperature. In some other embodiments, the LED chips may include multiple types of LED chips, e.g. with different color temperatures, color or other optical parameters.

When multiple types of LED chips, the LED chips may be used for mixing one or more than one optical settings, like several color temperatures.

Furthermore, a manual switch may be connected to a driver circuit for receiving a user operation to change color temperatures of the downlight apparatus. In some other embodiments, different driving currents or different duty ratio currents are supplied to the LED chips to mix desired optical parameters.

The light source play may be a circular flat plate or other geometrical structure. One side that facing down side with respect to a ceiling is called the bottom side. The bottom side of the light source plate is used for mounting the LED chips.

The heat sink includes a heat contact part and a heat dissipating part. The heat contact part is close to a heat source, like the light source plate, by directly or indirectly contacting the light source plate. For example, the heat contact part directly engages the light source plate. In some other designs, additional heat material like heat dissipation glue may be applied between the light source plate and the heat contact part of the heat sink.

The heat contact part may have a contact area with similar shape as the light source plate for the two parts to engage more closely.

The heat sink includes a heat contact part and a heat dissipating part. In some embodiments, the heat contact part has a shape corresponding to the light source plate. For example, the heat contact part may have a contact area with similar shape as the light source plate for the two parts to engage more closely. In some other embodiments, the heat contact part is a ring structure directly or indirectly engaging a peripheral area of the light source plate.

Some heat dissipating material, like glue, may be applied to further enhance heat transmission between the heat contact part of the heat sink and the light source plate.

Heat received from the heat contact part of the heat sink is further transmitted to the heat dissipating part. The heat dissipating part further transmits received heat to one or more other components.

In some embodiments, the heat sink is placed above the light source plate. Specifically, a bottom side of the heat contact part is heat connected to a top side of the light source plate. The term "heat connected" refer to heat conduction between two components with directly engagement or indirectly engagement with some other components like heat dissipating material placed between the two components.

The reflective cup includes a neck portion heat connected to the heat dissipating part. Specifically, in some embodiments, the reflective cup has a widen bottom edge and a narrow top edge. The neck portion refers to the area close to the narrow top edge. The reflective cup may have an opening corresponding to the shape of the light source plate.

In addition, the reflective cup has a top surface heat connected to the heat dissipating part of the heat sink. With such design, heat of the light source plate is carried from the heat contact part of the heat sink to the heat dissipating part of the heat sink. In addition, heat is further transmitted from the heat dissipating part of the heat sink to the reflective cup. The heat dissipating part of the heat sink may directly engage the top surface of the reflective part, or indirectly engage the top surface of the reflective cup, e.g. applying some heat dissipating glue between the top surface of the reflective cup and the heat dissipating part of the heat sink.

The reflective cup has an inner reflective surface surrounding the light source plate for reflecting a light emitting from the light source plate to predetermined directions. Specifically, the inner reflective surface may form a surrounding dome or cup shape with a light opening.

Light emitted from the light source plate may escape from the light opening directly, or be emitted to the inner reflective surface of the reflective cup and reflected for one or multiple times before the light is escaped from the light opening.

There may be a diffusion cover covering the light opening, or other designs like some mentioned below.

The inner reflective surface may be attached with reflective material like white paint, or disposed with optical guiding structures for showing shining surface or enhancing light reflection.

In some embodiments where driver circuits are not directly integrated with the light source plate, the driver circuits are placed in the driver container. The driver container may be a box of any geometrical shape, e.g. with a bottom shape similar to the top edge of the reflective cup and the light source plate.

In some embodiments, the driver container may also contain wireless or wire communication circuits and related processing circuits for converting an external command to a corresponding signal to control the LED downlight apparatus.

The driver circuit is electrically connected to the LED chips via a conductor path, e.g. wires or conductive strips. In some embodiments, the driver container may have a passing hole for the conductor path to pass through. Furthermore, the heat sink may also have a passing hole for the conductive path to route and to connect to the LED chips of the light source plate. In some embodiments, the passing hole may contain one or more sub holes corresponding to wire.

Plugging sockets may also be used for electrically connecting the driver circuit to the LED chips. The driving current converted by the driver circuit is sent to the LED chips.

The light source plate has a heat dissipating substrate for conducting heat of the LED chips to the heat contact part of the heat sink.

Figure 14:
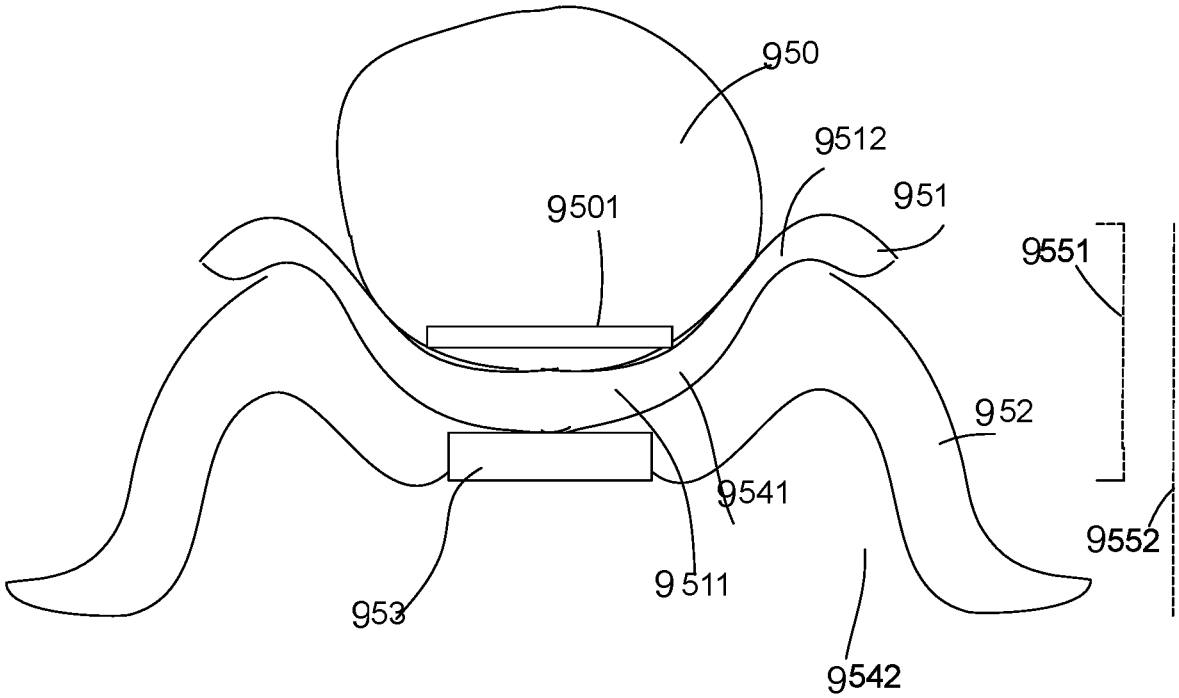
FIG. 14 is a diagram illustrating relation among components.

Please refer to FIG. 14. FIG. 14 is a diagram illustrating relation among components.

In FIG. 14, the LED downlight apparatus includes a light source plate 953, a heat sink 951, a driver container 950 and a reflective cup 952.

The reflective cup 952 have double inverted curved surfaces, forming a first cup 9542 for reflecting the light of the light source plate and a second cup 9541 for containing the driver container 950. The lateral wall of the driver container 950 and the light source plate 953 engage the heat contact part 9511 of the heat sink 951. The heat is carried to the heat dissipating part 9512 of the heat sink 951.

The reflective cup height 9552 and the heat sink height 9551 may be controlled based on design requirements. For example, the heat sink height 9551 may be less than 50% of the reflective cup height 9552. A driver circuit board 9501 is placed at bottom of the driver container 950.

Please refer to FIG. 10, FIG. 11, FIG. 12 and FIG. 13.

Figure 10:
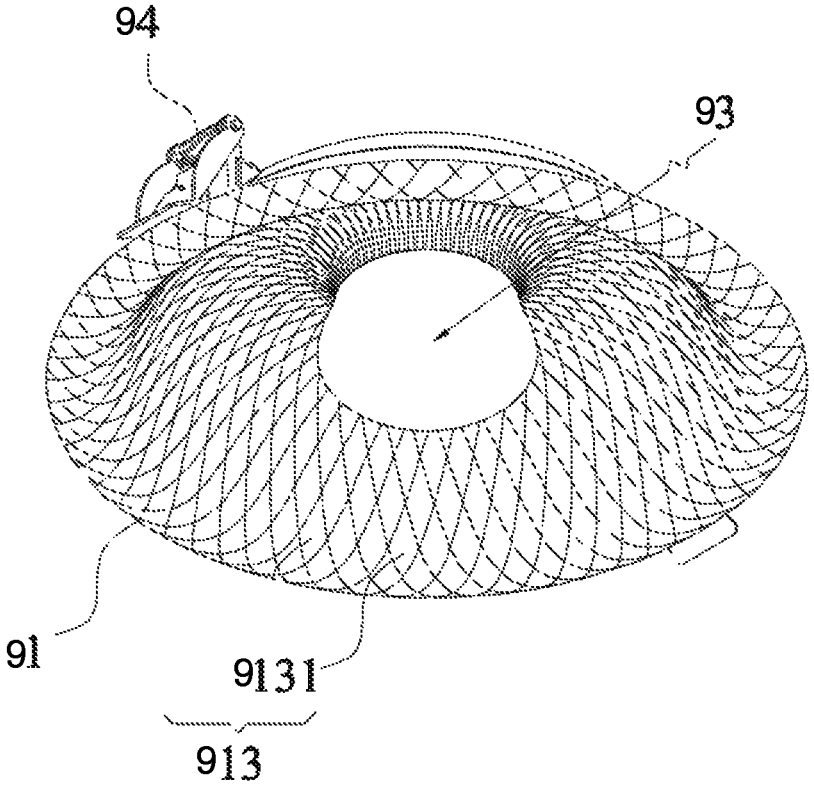
FIG. 10 is a perspective view of a LED downlight apparatus.
Figure 11:
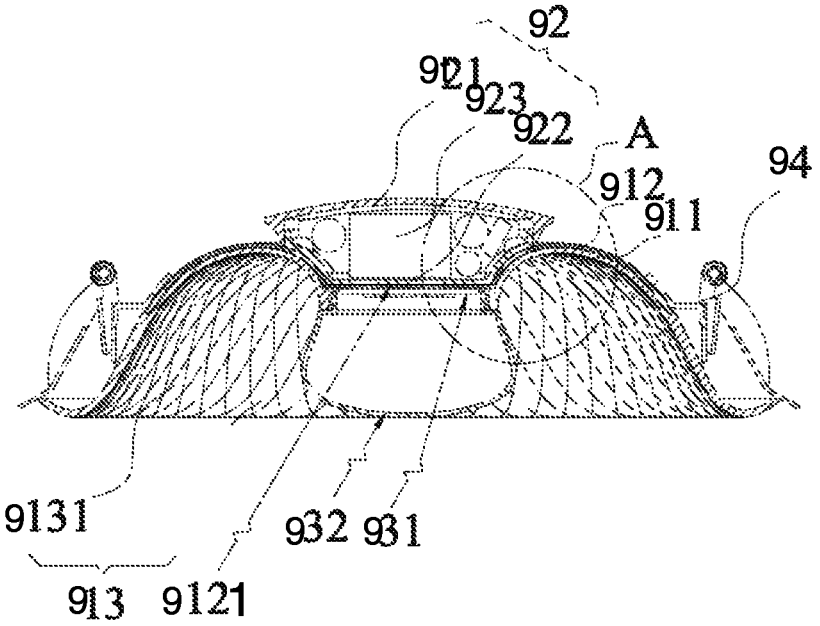
FIG. 11 is a cross-sectional view of the embodiment of FIG. 10.
Figure 12:
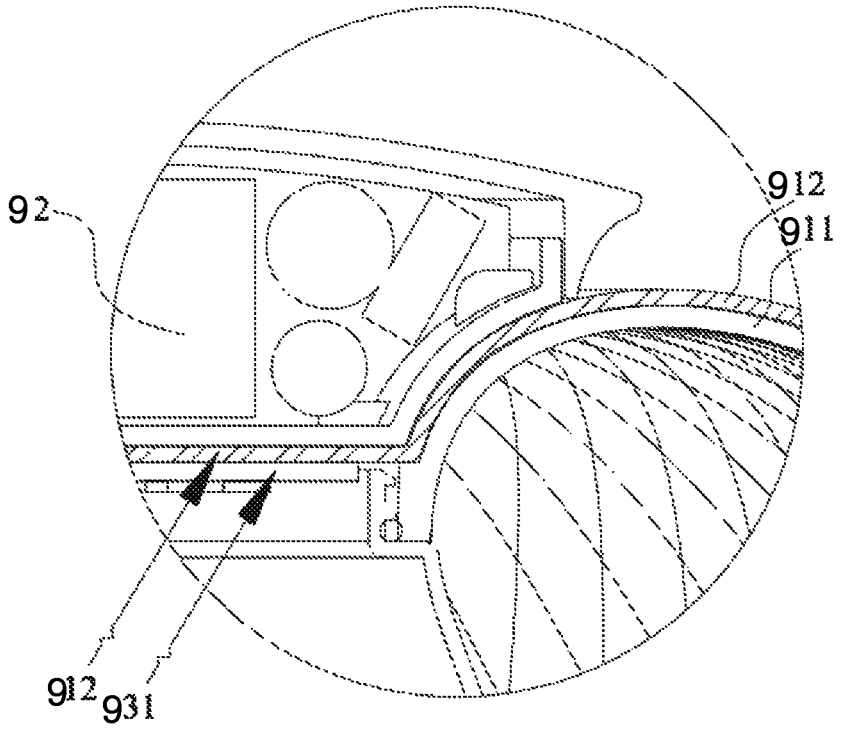
FIG. 12 illustrates a zoomed view of some components.
Figure 13:
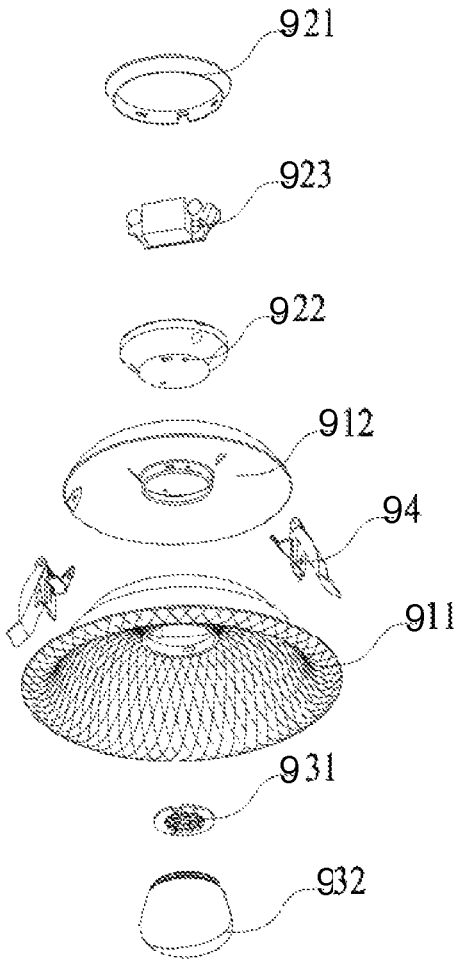
FIG. 13 is an exploded view of components of the embodiment of FIG. 10.

FIG. 10 is a perspective view of a LED downlight apparatus. FIG. 11 is a cross-sectional view of the embodiment of FIG. 10. FIG. 12 illustrates a zoomed view of some components. FIG. 13 is an exploded view of components of the embodiment of FIG. 10.

In FIG. 10, there are wing springs 94 for fixing the downlight apparatus to a ceiling.

The reflective cup 91 has an inner reflective surface 913 covered with polygonal structures 9131. A shielding cover 91 covers a light source plate (not shown) for visual effect, preventing glare effect or guiding light to desired directions.

In FIG. 11, the driver container 92 has a top cover 921 and a bottom plate 922 for containing driver circuits 923.

The circle A is illustrated in enlarged view in FIG. 12. The heat sink 912 is placed between the driver container and the light source plate 93.

The heat sink 912 has a heat contact part 9121 engaging the light source plate 931. The light source plate 931 is covered by the shielding cover 932. Other reference numerals refer to the same component in FIG. 10 to FIG. 13.

In FIG. 12, it shows the heat sink 912 has a heat dissipating part with the same curve shape as the underlying reflective cup 911 for passing heat to the reflective cup 911.

In FIG. 13, components of the embodiment of FIG. 10 are listed for a more clear view.

In some embodiments, the driver container engages a top side of the heat contact part of the heat sink. There are various ways to implement this feature. For example, the heat sink is arranged between the driver container and the light source plate. In such design, heat of the light source plate may also be transmitted to the driver container. When the driver container is made of metal material, the driver container may also be used for heat dissipation.

In some embodiments, the driver container has a bottom side and a lateral wall. At least a part of the lateral wall of the driver container engages the heat contact part of the heat sink. For example, when the driver container is a circular box, the bottom side of the circular box may engage a first part of the heat contact part of the heat sink and the lateral side are partly or completely engage a second part of the heat contact part of the heat sink.

For example, the heat contact part of the heat sink may be a cup shape structure so that the driver container is placed in the cup structure.

In some other embodiments, at least another part of the lateral wall is not contacting the heat sink. In such case, the driver container may not need to completely surrounded by the heat contact part of the heat sink.

In some embodiments, a heat sink height of the heat sink is less than 50% of a reflective cup height of the reflective cup. With the design mentioned above, the overall height of the LED downlight apparatus may be decreased.

In some embodiments, the heat sink may spread and cover most of the reflective cup. In some other embodiments, to decrease cost, the heat sink only covers part of the reflective cup, e.g. less than 50% of height of the reflective cup.

In some embodiments, the driver circuit is mounted on a circuit plate. The circuit plate is attached to the bottom side of the driver container. With such design, the heat of the driver circuit may easily carried away by the heat contact part, too.

In some embodiments, the reflective cup and the heat sink are circular shape structures.

In some embodiments, the inner surface of the reflective cup are disposed with polygonal structures.

Specifically, in a first design, the polygonal structures have convex protruding surface. Such design brings a first optical guiding and visual effect.

In some other design, the polygonal structures have concave surface, which brings a second optical guiding and visual effect.

The polygonal structures may look like fins of a fish or a crystal decoration.

In some embodiments, the polygonal structures close to the light source plate and away from the light source plate are different. For example, the polygonal structure may have different sizes for those near the top edge of the reflective cup compared to those near the bottom edge of the reflective cup.

In some embodiments, the heat sink forms a concave cup facing upwardly and the light source plate is placed in the concave cup. In such design, the reflective cup may have two inverted curve surfaces. The first curve surface forms a first cup for reflecting the light of the light source plate and the second curve surface forms a second cup for holding the driver container.

Such design may further decrease the overall height of the downlight apparatus.

In some embodiments, the reflective cup comprises a streamline bell shape structure.

In some embodiments, the downlight apparatus also has a shielding cover covering the light source plate. The light emitted from the plurality of LED modules passes through the shielding cover.

In some embodiments, the shielding cover has a bottom lens for forming a light beam and a lateral wall of the shielding cover for passing light on the reflective cover forming a second luminous source. For example, the light of the second luminous source emits to the inner reflective surface while the light via the bottom lens is directly emitting outside the LED downlight apparatus.

In some embodiments, the reflective cup has a hook structure for plugging and fixing the shielding cover. The hook may have an inverted hook to prevent detachment between the reflective cup and the light source plate.

In some embodiments, the downlight apparatus may also have a heat conductive layer disposed between the light source plate and the heat sink. Glue or other heat conductive material may be used for forming the heat conductive layer.

In some embodiments, the heat sink is made of metal material.

In some embodiments, the heat sink has a plurality of protruding bars on a surface of the heat sink to increase the rigidity of the heat sink and the reflective cover. Such protruding bars may form a grid or other shape to strengthen the rigidity of the attached reflective cup.

In some embodiments, the light source plate also engages an edge of the reflective cup.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A downlight apparatus, comprising:

a light source plate mounted with a first set of LED chips and a second set of LED chips, the color temperature of the first set of LED chips being different from the second set of LED chips;

a driver box with a top driver box and a bottom driver box for containing a driver plate mounted with a driver circuit for receiving a color temperature setting to adjust a light ratio between the first set of LED chips and the second set of LED chips, the top driver box comprising a thin hole and a sliding groove;

a switch button with a switch socket, wherein the switch button has a button top with only grooves on a surface of a button plate for a user to operate;

a switch unit mounted on the driver plate with a lever protruding upwardly inserting into the switch socket, the switch button being disposed on a top side of the top driver box and the switch unit being disposed on a bottom side of the top driver box, the switch button being capable of sliding along the sliding groove limiting by the thin hole, wherein a position of the switch button with respect to the sliding groove causes the driver circuit to generate a corresponding driving ratio to the first set of LED chips and the second set of LED chips, wherein the driver circuit comprises a PWM controller for adjusting a first duty ratio of the first LED chips and a second duty ratio of the second LED chips to change a mixed color temperature of the first set of LED chips and the second set of LED chips, wherein summation of the first duty ratio and the second duty ratio is 100%, wherein when the first set of LED chips are turned on, the second set of LED chips are turned off, wherein the driver circuit comprises a wireless circuit, an external command from an external device is sent to the wireless circuit to disable a function of the switch unit, wherein when the switch unit is disabled, a position change of the switch button does not change the corresponding driving ratio of the first set of LED chips and the second set of LED chips.

2. The downlight apparatus of claim 1, wherein there are multiple candidate positions for the switch button to be moved, corresponding to multiple corresponding color temperatures.

3. The downlight apparatus of claim 1, wherein the driver box has a bottom side and a lateral wall, at least a part of the lateral wall of the driver container engages a heat contact part of a heat sink.

4. The downlight apparatus of claim 3, wherein at least another part of the lateral wall is not contacting the heat sink.

5. The downlight apparatus of claim 3, further comprising a reflective cup, wherein a heat sink height of the heat sink is less than 50% of the reflective cup height of a reflective cup.

6. The downlight apparatus of claim 5, wherein the reflective cup and the heat sink are circular shape structures.

7. The downlight apparatus of claim 5, wherein the inner surface of the reflective cup is disposed with polygonal structures.

8. The downlight apparatus of claim 7, wherein the polygonal structures have convex protruding surface.

9. The downlight apparatus of claim 8, wherein the polygonal structures have concave surface.

10. The downlight apparatus of claim 1, wherein a heat sink forms a concave cup facing upwardly and the light source plate is placed in the concave cup.

11. The downlight apparatus of claim 10, wherein the reflective cup comprises a streamline bell shape structure.

12. The downlight apparatus of claim 1, further comprising:

a heat conductive layer disposed between the light source plate and a heat sink.

13. The downlight apparatus of claim 12, wherein the heat sink is made of metal material.

14. The downlight apparatus of claim 13, wherein the heat sink has a plurality of protruding bars on a surface of the heat sink to increase the rigidity of the heat sink and a reflective cover.

15. The downlight apparatus of claim 1, wherein the light source plate engages an edge of a reflective cup.

* * * * *